United States Patent [19]

Horton et al.

[11] Patent Number: 4,809,482

[45] Date of Patent: Mar. 7, 1989

[54] PACKAGING SYSTEM

[75] Inventors: Gilbert L. Horton, Kernersville; William A. Borst, Burlington; Herman M. Respess, Tobaccoville; Michael P. Langlois, Greensboro; Eddie D. Poole, Lexington; J. E. Swaim, Winston-Salem, all of N.C.

[73] Assignee: Sara Lee Corporation, Winston-Salem, N.C.

[21] Appl. No.: 114,062

[22] Filed: Oct. 29, 1987

[51] Int. Cl.[4] ..... B65B 43/26; B65B 61/26

[52] U.S. Cl. ..... 53/131; 53/281; 53/287; 53/290; 53/541; 53/564

[58] Field of Search ..... 53/131, 281, 287, 290, 53/291, 292, 487, 540, 541, 564; 414/93, 96; 493/316, 313, 309

[56] References Cited

U.S. PATENT DOCUMENTS

| | | | |
|---|---|---|---|
| 1,673,014 | 6/1928 | Morrison . | |
| 2,433,701 | 12/1947 | Linstedt | 53/564 X |
| 2,710,566 | 6/1955 | Ahlmeyer et al. | 493/316 |
| 2,900,773 | 8/1959 | Koch | 53/495 |
| 2,924,051 | 2/1960 | More | 53/447 |
| 3,138,905 | 6/1964 | Ellinger | 53/485 |
| 3,262,242 | 7/1966 | Godschalx | 53/55 |
| 3,553,929 | 1/1971 | Revicki | 53/497 |
| 3,688,466 | 9/1972 | Geyer | 53/287 X |
| 3,844,423 | 10/1974 | Loomer et al. | 414/96 |
| 3,941,037 | 3/1976 | Reichert | 493/167 |
| 4,160,352 | 7/1979 | Neff | 53/287 X |
| 4,492,070 | 1/1985 | Morse et al. | 53/438 |
| 4,570,420 | 2/1986 | Raz | 53/485 |

FOREIGN PATENT DOCUMENTS

| | | | |
|---|---|---|---|
| 409761 | 10/1966 | Switzerland | 414/93 |

*Primary Examiner*—Robert L. Spruill
*Assistant Examiner*—Beth Tenney

[57] ABSTRACT

A system of packaging a predetermined number of relatively flat packages or envelopes containing delicate articles such as hosiery, pantyhose, etc., into boxes. The packages or envelopes are printed and garments placed therein at a selected location and then placed on a substantially horizontal conveyor, conveyed to a vertical elevator having provision at the top thereof to accumulate a predetermined number of such packages or envelopes, and then automatically moved from the accumulator to an awaiting open tray or box bottom and placed therein. Prior to arriving at the opened tray, such tray has been automatically removed from a magazine, the sides and ends unfolded and placed on a platform in opened condition awaiting the arrival of the predetermined number of packages or envelopes. Once the envelopes or packages are placed in the tray the same is automatically transferred to a lid opening and applying station where the lid and filled tray are united. The filled box is now automatically moved to a printing station where information is printed on the box and the same is automatically moved to a station where it and other similar filled boxes are placed in a larger carton or container and moved to a loading area.

16 Claims, 4 Drawing Sheets

FIG. 1
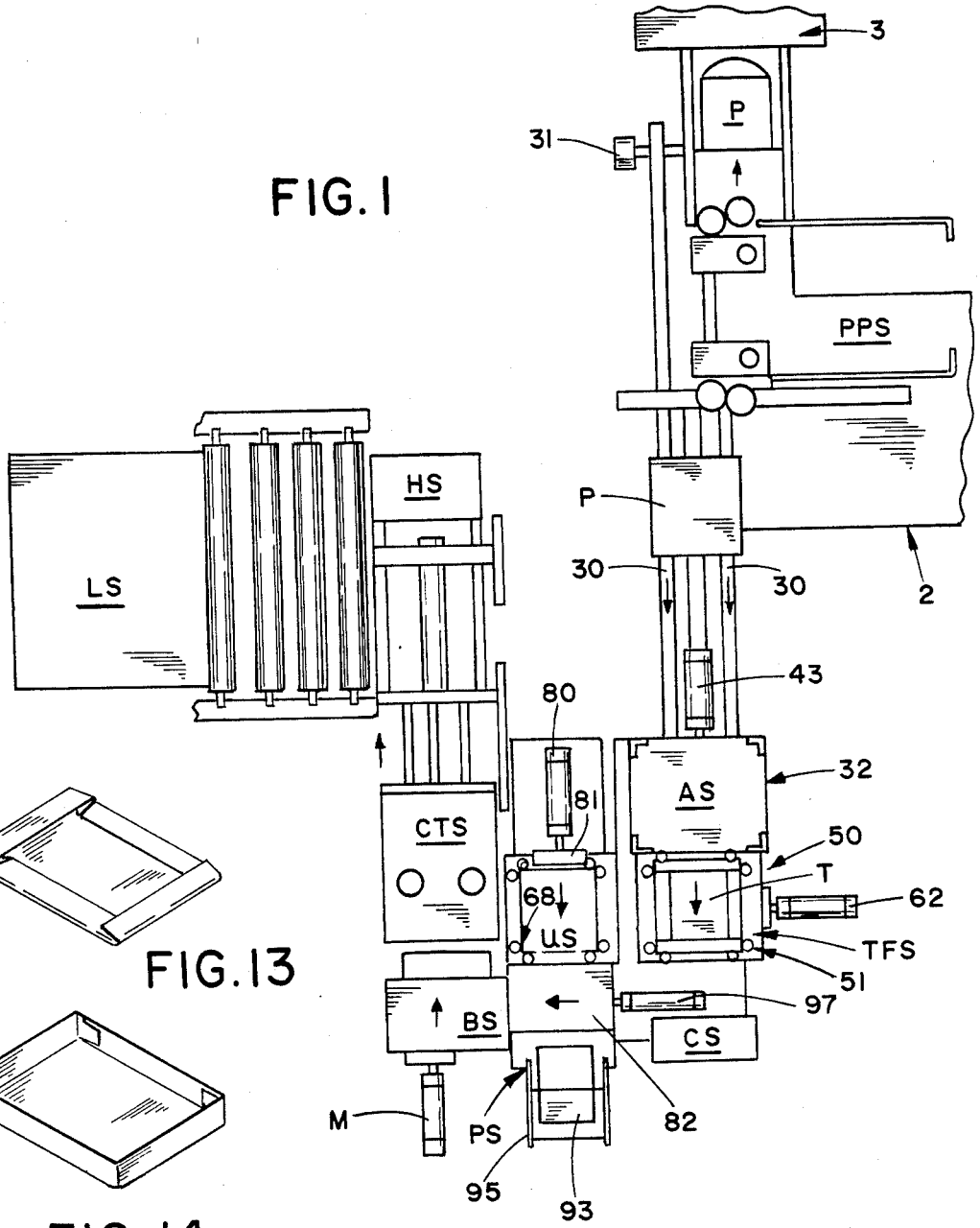
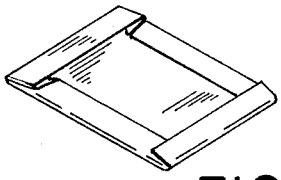
FIG. 13
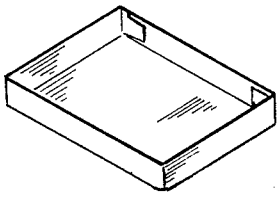
FIG. 14
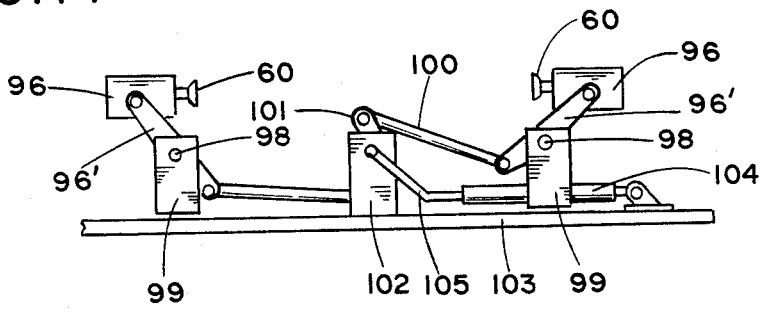
FIG. 11

FIG. 7
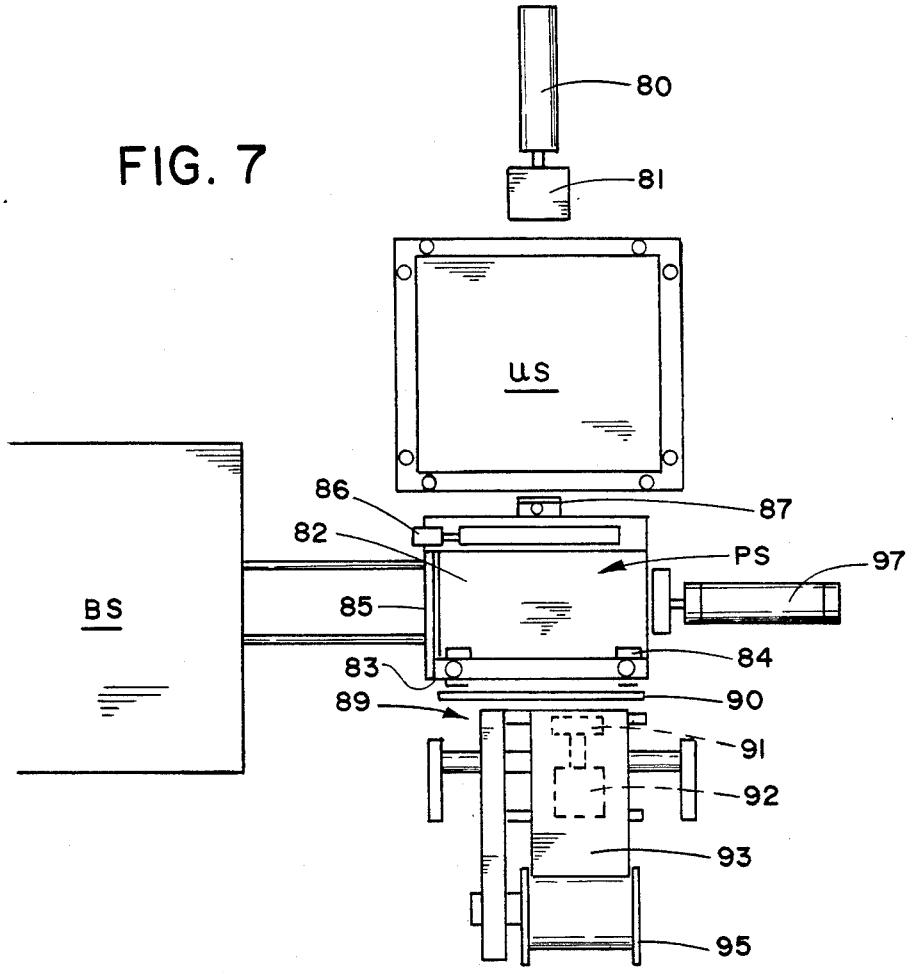
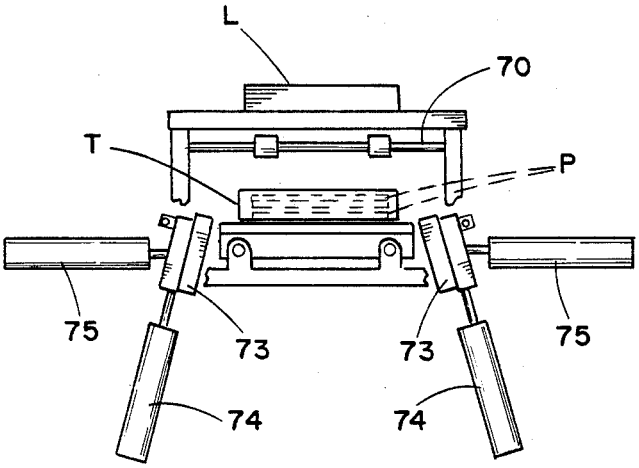
FIG. 8
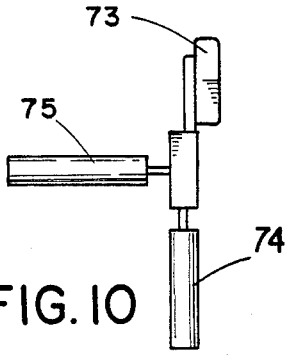
FIG. 10
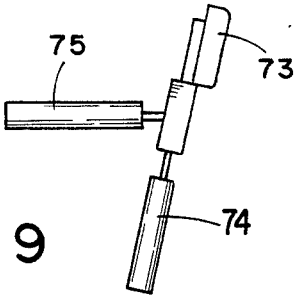
FIG. 9

PACKAGING SYSTEM

BACKGROUND OF THE INVENTION

This invention relates generally to the packaging of relatively flat packages or envelopes containing, for example, delicate garments such as ladies, hosiery and pantyhose, in an automatic manner. Previous packaging systems oftentimes required manual dexterity and skill to prevent damage during loading such packages or envelopes into boxes and such boxes into cartons or cases for final delivery. Various prior art systems have improved substantially through the years but have not addressed the specific problems in packaging relatively flat packages or envelopes such as herein noted. The boxes are usually fed to a loading area in opened condition thereby requiring substantial more space than if they are placed in a magazine in a flattened condition and then subsequently opened and filled.

Numerous systems are known that hint at a solution to the problems involved in this industry but don't offer a complete adequate solution. The following U.S. patents attempt to but fall short of what is being accomplished by the present invention: U.S. Pat. Nos. 1,673,014 to Morrison; 2,900,773 to Koch; 2,924,051 to More; 3,138,905 to Ellinger; 3,262,242 to Godschalz; 3,553,929 to Reviciki; 3,941,037 to Reichert; 4,492,070 to Morse et al; and 4,570,420 to Raz.

SUMMARY OF THE INVENTION

The present invention relates to a programmed and automatic packaging system which is substantially faster, more accurate, trouble free and requires very little personal attention. In fact, a single attendant can easily oversee several strategically located such systems. At a first station, hereinafter referred to as a printing-packaging station PPS, a magazine is provided with a vertical stack of empty envelopes or packages P which are fed from the bottom of said stack through a printer 2, which prints product related information on both sides thereof, to a product insertion area where a product is inserted into the pocket thereof, the pocket closed and the filled envelopes advanced to a conveyor. The details of this part of the system PPS is the subject of another application Ser. No. 113,988 filed on even date herewith and is only advanced to illustrate a complete system. Individual filled packages or envelopes are fed by a conveyor to a vertically oriented elevator and to an accumulating area or station AS thereabove where a predetermined number of such packages or envelopes are accumulated. Upon accumulating the desired number of packages, a signal automatically actuates a prime mover which transfers the accumulated packages to an adjacent open tray or box bottom and places them therein. Prior to this, provisions are made to remove the tray in a folded, flattened condition from a supply magazine, unfold the sides and ends thereof, and place the same on a platform in an opened condition awaiting the arrival of the packages or envelopes at a tray filling station TFS. The filled tray is then moved to a position below a magazine of tray or box lids, the sides and ends of which have been opened similar to corresponding sides of the tray. The filled tray is moved upwardly and guided into the opened lid and united therewith at station US, at which time the box, the tray and lid having been united to define the box, is lowered and laterally transferred to a printing station PS where product information is printed on a side thereof and subsequently further transferred to and inserted into a larger box, carton or container etc. BS. From the time the first printing operation PPS of the packages or envelopes until the filled boxes have been inserted into the larger box, carton, container or the like, a control or programmed system CS controls the entire sequential steps of the operation in a conventional manner through the use of various switches, sensors, controls, and the like which activate the various motors, actuators, etc.

BRIEF DESCRIPTION OF THE DRAWING

In the drawings:

FIG. 1 is a schematic top plan view of the entire packaging system;

FIG. 7 is a schematic top view of the printing and transfer station;

FIG. 8 is a side-view of the tray guiding mechanism;

FIGS. 9 and 10 show the positions of the individual tray guides;

FIG. 11 shows a side elevational view of the tray side and end unfolding or opening mechanism;

FIG. 13 is a perspective view of one portion of the box in a flattened or folded condition; and FIG. 14 is a perspective view of the box portion in an opened condition.

Figure 4:
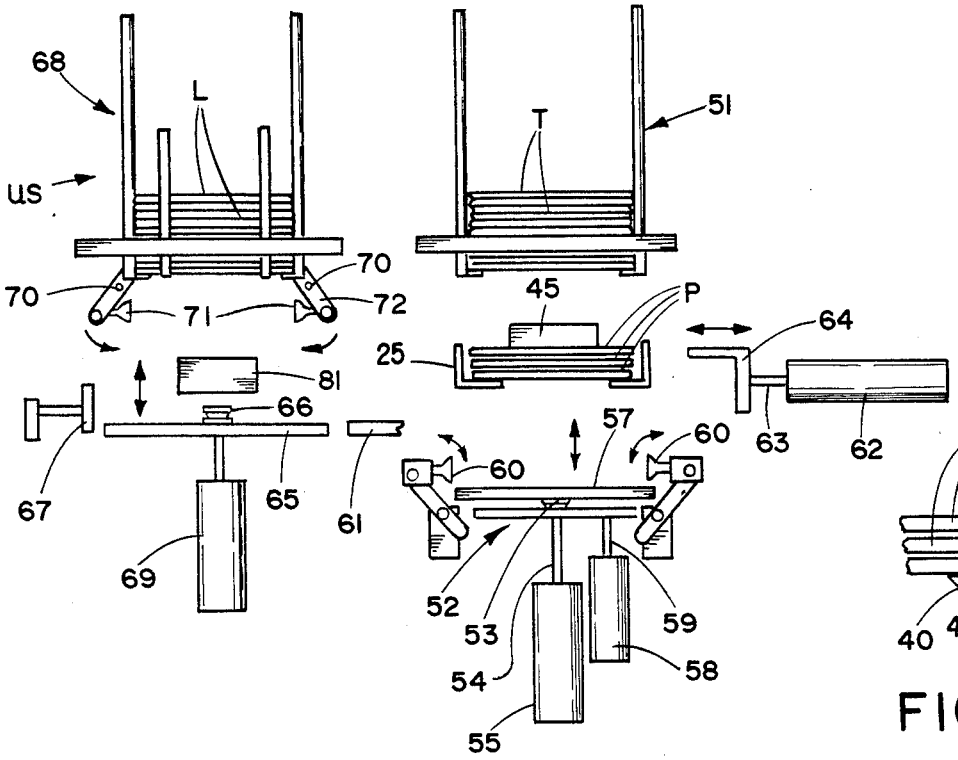
FIG. 4 is a schematic end view of the tray and lid magazines with the associated opening and transfer devices.
Figure 12:
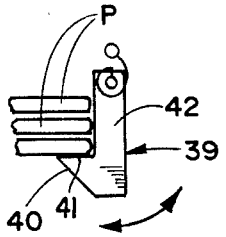
FIG. 12 is an enlarged, fragmentary view of one side of the package accumulator.

Referring now to the drawings, in which like reference numerals refer to corresponding parts throughout the several views, the reference character PPS denotes a printing-packaging station including a stack or supply 1 of empty, non-printed envelopes or packages P which are fed from the bottom thereof through a printer 2, which prints product information on one or both sides thereof, and to a product loading or insertion area 3 where such product, such as hosiery, pantyhose,.and the like, is inserted into the pocket thereof; the pocket closed and the filled envelope advanced to a conveyor. The specific details of this portion of the system is the subject matter of another application as mentioned above.

VERTICAL ELEVATOR AND ACCUMULATING STATION

Figure 2:
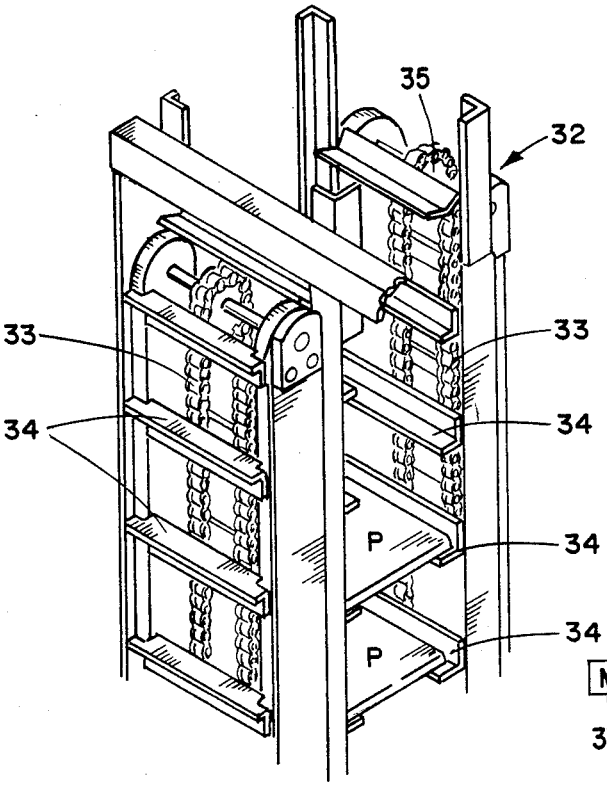
FIG. 2 is a fragmentary, perspective view of the vertical elevator.
Figure 3:
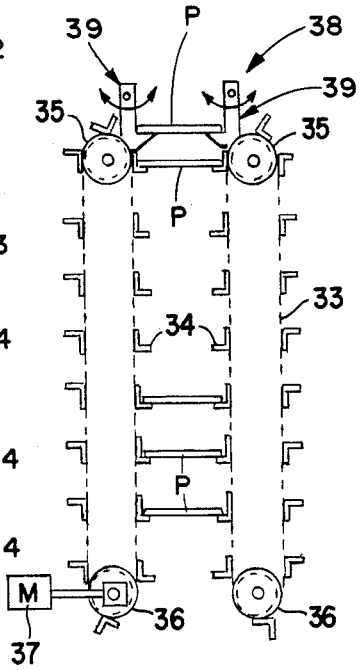
FIG. 3 is a side elevational view of the vertical elevator and package accumulator assembly.
Figure 5:
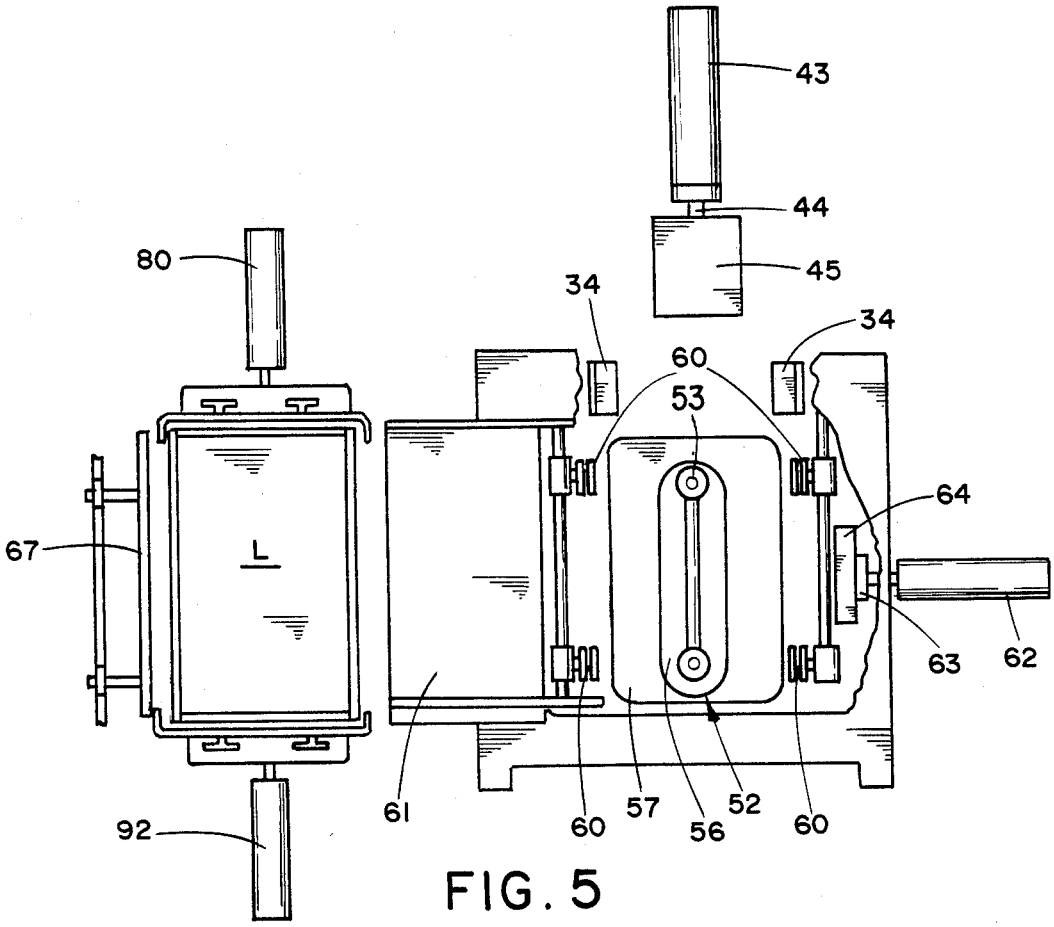
FIG. 5 is a top view, with parts broken away for clarity, of the tray handling mechanism, transfer platform, and lid magazine.

An endless conventional conveyor system 30 is horizontally disposed and driven by any suitable drive means 31, for moving packages P from a printing and packaging station PPS to a vertical elevator and accumulator station AS. The elevator 32 includes longitudinally spaced endless chain-like members 33, FIGS. 2 and 3, which have shelves 34 attached thereto in spaced, opposed relationship, each endless member 33 being in mesh with upper 35 and lower 36 sprockets as clearly illustrated in FIG. 3. Lower sprockets 36 are driven by drive means 37. As the outermost runs of the chain members 33 move downwardly and around lower sprockets 36, opposed shelves 34 move beneath a package P and lift it from the conveyor 30. Above this elevator and spanning the longitudinal space between the chain like members 33 is an accumulator 38 which includes plural spaced pivoted spring biased supports 39 having angled surfaces 40 engageable with package P as the same is elevated and pressed thereagainst by the elevator. Supports 39 include horizontal package support surfaces 41 and vertical sections 42 to support a predetermined number of packages. Note that the uppermost package P being lifted vertically by an opposed pair of elevator shelves 34, 34 will engage the inclined surfaces 40 of supports 39 and pivot supports 39 laterally outwardly until said package is slightly above the support surface 41 at which time said spring biased supports will snap back to the original FIG. 3 position as the conveyors begin their downward trend. When a predetermined number of packages P have accumulated on supports 39, a conventional sensor, through controls CS activates a reciprocating motor 43, FIG. 5. The motor 43 is preferably, but not necessarily a fluid motor, having an extensible and retractable rod 44 for supporting a pusher plate 45, which moves the accumulated predetermined number of packages to an awaiting open tray or the bottom portion T of a box, FIGS. 1 and 4. In a preferred embodiment, three packages are received upon supports 39 before actuation of motor 43.

PACKAGE BOXING STATION

Immediately adjacent the accumulator 38 is a boxing or cartoning station 5 which includes a supply magazine 51 of flattened box trays or box lower portions T, e.g., having the sides and ends folded upwardly. Immediately below supply magazine 51 is a tray removal or extracting device 52, FIGS. 4 and 5 which includes spaced interconnected suction or vacuum cups 53 attached to the upper end of rod 54 of vertically reciprocatably motor 55 which may be a fluid motor. Rod 54 and suction cups 53 extend through an opening 56 of a vertically reciprocable tray or bottom support 57 moveable by means of a motor 58 and rod 59. Mounted around the periphery of support 57 are pivotally mounted suction cups 60, FIG. 4, 5 and 11, to be specifically described later, adapted to grasp and open or unfold the ends and sides of trays T to open same to receive a predetermined number of packages P. This arrangement functions or operates in the following manner; in response to a signal that indicates the need for a tray T, suction cups 53 moved upwardly by rod 54 and motor 55 to engage and grasp the bottom of a tray T located in supply magazine 51 and return the same to support 57 where it is held by suction cups 53. During this time suction cups 60 are caused to pivot from the horizontal, FIG. 4, positions to the vertical positions and grasp the folded sides and ends of tray T. When cups 60 grasp the ends and sides, they are then moved back to their original position, thus unfolding the sides and ends and opening said tray for receiving a predetermined number of packages P from accumulator 38 upon actuation of pusher 43, 44 and 45. Support 57 is now supporting an open tray or bottom T, pusher 45 is actuated moving packages P from supports 39 of accumulator 32 through guides 25, FIG. 4, located between said accumulator 32 and magazine 51 and tray removal device 52 into the awaiting opened tray. At this time the filled tray is ready to be transferred to tray-lid uniting station U.S. The pusher 45 is retracted to its original position, suction cups 60 are evacuated, support 57 with a now filled opened tray is moved upwardly by motor 58 in horizontal alignment with a transfer platform 61, FIGS. 4 and 5. A motor 62 having a reciprocating rod 63 supporting a transfer plate or tray engaging member 64 is actuated, pushing filled tray or bottom T off of platform 57 over transfer platform 61 onto a vertically reciprocatable support 65 having vacuum cups 66 thereon and against stop 67 to position filled tray T directly below a lid magazine 68 having a supply of lids or box tops L with their ends and sides folded and facing downwardly. Attached to and closely beneath the periphery of the lid supply magazine 68 are pivotally mounted rods 70 supporting suction or vacuum cups 71 via levers 72 which function similar to cups 60 for the trays T. e.g., they pivot upwardly, grasp the four folded, collapsed sides of lid L and open or unfold them so that they extend downwardly in vertical planes. At the same time guides 73 are moved upwardly by motors 72 inside the now opened lid to guide filled tray T into opened lid L. Filled tray T is elevated by reciprocating motor 69. FIGS. 8 and 9 show how guides 73 are moved into the now opened lid L at an angle and then pivoted to the upright position by motor 75, at which position they act as guides for the filled tray entering the opened lid. Suction cups 71 now release the side and pivot out of the way. Once the lid L and tray T are united, thereby defining, a box filled with packages, the guides 73 are tilted and simultaneously lowered to their original position completely clear of all structure at this lid and tray uniting station US. The box of packages is now lowered back down to the original position of the filled tray and is in position to be moved to a printing station PS for printing.

PRINTING STATION

Figure 6:
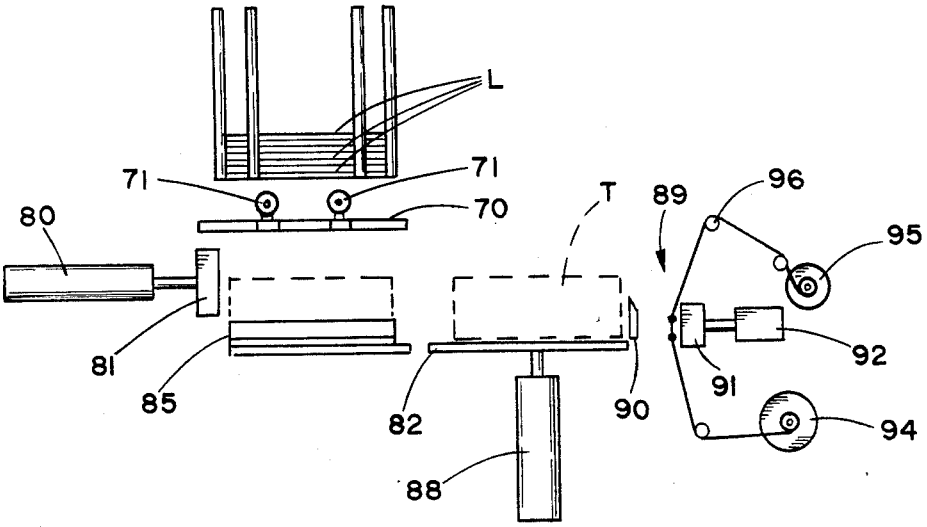
FIG. 6 is a schematic side view of the lid-tray uniting area and the box printing mechanism.

Double acting fluid motor 80 has attached thereto a pusher plate 81, see FIGS. 1, 4, 6 and 7, and is located in a position approximately 90° with respect to motor 62 of the tray filling station TFS and is adapted to push the filled box onto support 82, FIGS. 1, 6 and 7 under spring biased hold down presser 83, having upwardly angled shoe-like members 84 to guide the end of the filled box under the hold down 83. On the left, against a stop member 90 as viewed in FIG. 7, a pivotally mounted upstanding plate 85 is located to aid in holding the filled box in place while it is being printed. Double acting fluid motor 86 FIG. 7 pivots plate 85 from the out-of-the-way horizontal position to a vertical holding position. Note that motor 88 is located below the top surface of support 82. Another box holding pivoted plate 87, FIG. 7, is located opposite hold-down 83 and adjacent pivoted plate 85. Preferably a fluid motor not shown is employed to move plate 87 from a lower clear position to an upper holding position. Support 82 is mounted for vertical movement by motor 88 with the filled box firmly positioned to move the same in alignment with a printer 89 which prints data on an end of the filled box. On arrival at the printing station the filled box and support 82 are then elevated slightly, clearing stop member 90 and lowered to allow stop member 90 to enter the area between sides of tray T and lid L. Member 90 has tapered edge 91 to permit entry thereof between the sides of T and L. This plate provides a good rigid reaction surface against the pressure of reciprocating printer plate 91 via reciprocating motor 92. The printer illustrated includes a heated platen printing plate 91, printing ribbon 93, ribbon supply 94, spent ribbon take up reel 95 and various guides 96. Upon completion of the printing, motor 88 elevates the filled, and now printed box, to clear member 90, stops 85 and 87 are then retracted and a pusher motor 97 is actuated to move the same to and into a larger box or carton at boxing station BS.

From boxing or cartoning station BS the filled carton is moved by a motor M to carton transfer station CTS and then to a holding station HS where same is rerouted to a loading station LS. The details of boxing station BS, carton transfer station CTC handling station and loading station LS forms no part of the present invention and the broad description thereof is only offered to illustrate a description of a complete system.

FIG. 11 shows the tray opening suction cup arrangement which includes cups 60, supported by support 96 rigidly connected to lever 96' pivotally attached to 98 to support 99 and to a lever 100 which is attached to a lever 101 attached to an upstanding support 102 attached to elongated support 103. Also attached lo lever 101 is a reciprocating motor 104 and having an end 105 attached to upright 102 as well as lever 101. As motor 104 is extended lever 101 rotates in a clockwise direction causing cups 60 to move counterclockwise to engage and grasp the sides and ends of a tray to unfold same when motor 104 is reversed. This description relates to the right-hand side as viewed in FIG. 11. The left-hand side movement is opposite.

The controls, programs etc. for the sequential steps of the various mechanisms are of a conventional type and they may include computers, timer motors, timer switches and/or limit switches at appropriate locations, tape programs, counters, light sensitive switches etc. necessary to fully automate the system. The details of these controls are immaterial to present invention apart from an understanding thereof as the novelty lies in the structural organization and the operation of the several elements, subcombinations and combination as set out above. Appropriate electric and fluid circuitry and components is well within the capabilities of one skilled in the art of circuit design and mechanical engineering.

Having thus described the invention, what is claimed as new and for which it is desired to secure Letters Patent is:

1. Apparatus for packaging a predetermined number of relatively flat articles comprising; first conveyor means for moving said articles along a predetermined path from a processing area; a substantially vertically oriented elevator means aligned with said first conveyor means for removing and receiving said articles from said conveyor; accumulator means at the top of said elevator means for receiving articles from said elevator means and for supporting a predetermined number of said articles; first transfer means adjacent said accumulator means; means supporting a box tray or bottom, for receiving articles therein; means for activating said transfer means in response to a predetermined number of accumulated articles upon said accumulator for means to transfer the articles to said box tray or bottom; means for supporting a box lid or top; second transfer means for transferring the now filled tray or bottom to a vertically moveable support beneath said box lid or top; means to move said vertically moveable support and said filled tray or bottom to place same within said box lid or top and to retract the now closed and filled box and means adjacent the moveable support to transfer same to a further processing area.

2. The apparatus as defined in claim 1 wherein said elevator is defined by plural facing aligned angled shelves attached to endless chains in mesh with a pair of upper and a pair of lower sprockets and means for selectively driving one pair of said sprockets in synchronism with said conveyor.

3. The apparatus as defined in claim 2 wherein said accumulator means includes plural biased and pivoted supports in lateral spaced relation relative to each other and located at the upper end of said elevator at a position to receive the articles from said shelves as they reach their uppermost travel.

4. The apparatus as defined in claim 3 wherein said biased and pivoted supports are located on each side and slightly spaced from the remote ends of said shelves to receive said articles near the corners thereof.

5. The apparatus as defined in claim 1 further including means to drive said first conveyor and said elevator means intermittently and in synchronism relative to each other whereby when said elevator means is in stopped, article receiving position said conveyor is feeding an article thereto.

6. The apparatus as defined in claim 1 wherein both said first and said second transfer means are reciprocating motor means having object engaging pusher plates attached thereto.

7. The device as defined in claim 1 including a box bottom or tray supply magazine located above said box tray support means and means associated with said box tray or bottom support means for removing them one at a time from said magazine and placing same on said box tray or bottom support means for receiving said articles from said first transfer means.

8. The device as defined in claim 1 including a box top or lid supply magazine located above said vertically moveable support and means to move said vertically moveable support and said filled tray or bottom into the top or lid located thereabove.

9. The device as defined in claim 7 wherein each box bottom or tray has folded sides and ends and face upwardly and wherein said support means further includes means for unfolding said sides and ends to open same for receiving said articles.

10. The device as defined in claim 9 wherein said unfolding means includes suction cups mounted for pivotal movement from an inactive position remote from the sides and ends to an active position wherein said cups engage and grasp same and return to said first position thereby unfolding said sides and ends and means to so move said cups.

11. The device as defined in claim 8 wherein each box lid or top has folded sides and ends and face downwardly and wherein said magazine has mounted along the bottom peripheral edges thereof means to unfold said sides and ends to open same for receiving said filled tray.

12. The device as defined in claim 11 wherein said lid or top unfolding means includes suction cups mounted for pivotal movement from an inactive position away from the sides and ends to an active position wherein said cups engage and grasp same and return to said first position thereby unfolding said sides and ends to so move said cups.

13. The apparatus as defined in claim 1 further comprising means to guide said filled tray or bottom into said lid or top.

14. The apparatus as defined in claim 1 further comprising printing means adjacent said last mentioned moveable support having means associated therewith to hold said filled box for printing information on a side or end thereof when said last mentioned transfer means has moved said box holding means and means to actuate said printer.

15. The apparatus as defined in claim 14 including means adjacent said printing device for transferring said printer, filled box to a larger box or container for shipment.

16. A cartoning or boxing device for placing a predetermined number of relatively flat packages into containers, each container consists of a box tray and a box lid; means for accumulating a predetermined number of packages in superposed relation, means sequentially feeding a series of packages to said accumulator, first magazine means for supportin in superposed relation a plurality of box trays, means for transferring a box tray from said first magazine to a first box tray support means, means for transferring and depositing the predetermined number of packages in said box tray at said first box tray support means, second magazine means for supporting in superposed relation a plurality of box lids, means for transferring said box tray and packages therein from said first box tray support means to a second box tray support means positioned below said second magazine means and the lowermost box lid supported thereby, means for elevating said second box tray support means have a box tray and packages therein to said lowermost box lid to unite said box lid and box tray to form a closed container, said elevating means also including means for returning said closed container to a lowered position.

* * * * *